US007038387B2

(12) United States Patent
Obata et al.

(10) Patent No.: US 7,038,387 B2
(45) Date of Patent: May 2, 2006

(54) PULSE MAGNETRON WITH DIFFERENT ANODE AND CATHODE RADIUSES

(75) Inventors: Hideyuki Obata, Kamifukuoka (JP); Naoki Tsuji, Kamifukuoka (JP)

(73) Assignee: New Japan Radio Co., Ltd., Tokyo-to (JP)

( * ) Notice: Subject to any disclaimer, the term of this patent is extended or adjusted under 35 U.S.C. 154(b) by 69 days.

(21) Appl. No.: 10/712,831

(22) Filed: Nov. 12, 2003

(65) Prior Publication Data

US 2004/0104679 A1 Jun. 3, 2004

(30) Foreign Application Priority Data

Nov. 13, 2002 (JP) ..... 2002-329150

(51) Int. Cl.
*H01J 25/34* (2006.01)

(52) U.S. Cl. ..... 315/39.51; 315/39.71; 315/39.75

(58) Field of Classification Search ..... 315/39.51, 315/39.71, 39.75, 39.77
See application file for complete search history.

(56) References Cited

U.S. PATENT DOCUMENTS 2,869,012 A * 1/1959 Muller ..... 313/157
2,869,031 A * 1/1959 Herbert ..... 315/39.51
3,899,714 A * 8/1975 Esterson et al. ..... 315/39.51
6,222,319 B1 * 4/2001 Yoshihara et al. ..... 315/39.75

FOREIGN PATENT DOCUMENTS

| | | |
|---|---|---|
| GB | 2274941 | 8/1994 |
| JP | 55-100633 | 7/1980 |
| JP | 59-94330 | 5/1984 |
| JP | 59-94331 | 5/1984 |

OTHER PUBLICATIONS

English Abstracts JP 55-100633 (EPODOC/EPO; PAJ/JPO) Jul. 31, 1980.
English Abstracts JP 59-94331 (EPODOC/EPO; WPI/DERWENT; PAJ/JPO), May 31, 1984.
English Abstracts JP-59-94330 (EPODOC/EPO; WPI/DERWENT; PAJ/JPO), May 31, 1984.

* cited by examiner

*Primary Examiner*—Benny T. Lee

(57) ABSTRACT

A pulse magnetron includes a cylindrical shell anode, a cathode provided at the center of the anode having a number of vanes mounted radially on an inner wall of the cylindrical anode shell, and a pair of pole pieces provided for applying a magnetic field to an interaction space where the outer side of the cathode is opposed to inner ends of the vanes. The anode and the cathode are arranged to satisfy at least either (i) increasing the radius of the inscribed circle defined by the inner ends of the vanes or (ii) decreasing the radius of the cathode surface as the magnetic flux density along the axial direction of the cathode at both ends of the inner end of the height of the vanes.

2 Claims, 7 Drawing Sheets

PULSE MAGNETRON WITH DIFFERENT ANODE AND CATHODE RADIUSES

CROSS-REFERENCE TO RELATED APPLICATION

Priority is claimed under 35 U.S.C. §119 from Japanese application 2002-329150 filed Nov. 13, 2002.

BACKGROUND OF THE INVENTION

The present invention relates to a pulse magnetron designed for pulsing to generate microwaves. More particularly, the present invention relates to a pulse magnetron which has a construction for effectively attenuating generation of spurious radiation.

Such a magnetron includes, as shown in FIG. 7, a number of vanes 12 mounted radially on the inner wall of a cylindrical anode shell 11 with a cavity provided between any two adjacent vanes and the anode shell 11 and connected alternatively by straps 14 for stabilizing the oscillation in a n mode which all constitute an anode 1. As a cathode 2 is located at the center of the anode 1, the anode shell 11 has pole pieces 3 mounted to both axial ends thereof for applying a magnetic field substantially in parallel to the surface of the cathode 2 across an interaction space 4 between the inner side (at the inner end of the vanes 12) of the anode 1 and the outer side of the cathode 2. This causes electrons from the cathode 2 to make circular orbits by the right-angle force of the magnetic field in the interaction space 4 thus introducing energy to the resonant cavities for oscillation. The magnetron is commonly used in a radar system and energized with an anode voltage for pulsing operation.

In recent years, as a variety of microwave generators have been in use, their generation of spurious radiation is strictly controlled under relevant regulations. It is also a drawback of the pulse magnetron to develop spurious radiation at frequencies close to the fundamental oscillation frequency. When the magnetron used in a radar system is pulsed, its oscillation output level has a number of other lobes at sidebands in addition to the main lobe in the spectrum shown in FIG. 8. The spectrum is determined by the pulse width provided for actuating the pulse magnetron is not narrower than a spectrum of a Fourier analysis based on a oscillating output waveform. Inversely in general, the spectrum may be wider than its theoretical size due to various causes. Also, the shape of the spectrum is not linearly symmetrical about the fundamental oscillation frequency but may be biased as having a noticeable lobe profile (P) at one sideband, shown in FIG. 8, which causes spurious radiation.

One of the causes for creating faults in the spectrum such as an unsymmetrical shape or a noticeable lobe at the sideband may be oscillation off the predetermined operating timing at the rise in the pulse magnetron. When the anode voltage is gradually increased, the oscillation of the pulse magnetron will start at a current about 5 to 10% lower than its rated level. The output is thus 40 to 50 dB lower than the rated level as the oscillation is made at a frequency lower than the fundamental oscillation frequency. Since the pulse magnetron having the above described operating characteristics is pulsed, it is timed at such a lower current range with each pulse rise in the lower side of the fundamental frequency and its output is 40 to 50 dB lower than the rated level. As the result, the frequency spectrum will be unsymmetrical having a noticeable profile of −40 to −50 dBc (decibels) at one sideband.

It is hence known that the spurious radiation is caused by non-uniformity in the magnetic field at the interaction space between the anode and the cathode and thus variation in the relationship between the magnetic flux density and the electric field intensity. Then tentatively, the generation of noise can be attenuated by the vanes modified with its axial ends projecting more than the center in the axial direction.

SUMMARY OF THE INVENTION

As described above, every conventional magnetron exhibits an unfavorable profile close to the fundamental oscillation frequency of the spectrum caused by unwanted oscillation at the rise of pulse, thus causing an unsymmetrical shape of its spectrum to occur and producing the spurious radiation. It is necessary for reshaping the spectrum of the output of the radar system by installing a filter in the radar system. As the radar system is commonly mounted to a higher location in a ship, however, it has to be minimized in its size and weight. Also, the filter has to be higher in the dimensional accuracy for passing the fundamental frequency without significant attenuation while filtering undesired frequencies and its cost will hence be increased.

When the vanes are arranged with their axial ends projecting for compensating for a non-uniformity of the magnetic field across the interaction space, the distance between the anode and the cathode becomes smaller, but the drawback that the oscillation starts at a current lower than the rated level will not be eliminated. As the spurious radiation occurs at lower currents, unwanted oscillation at the rise of pulse will not be attenuated.

The present invention has been developed for eliminating the above drawback and its object is to provide a pulse magnetron which can inhibit unwanted oscillation at an operation point lower than the rated level in the rise or decay of a pulse, attenuate spurious radiation at lower frequencies than the fundamental oscillation frequency, and produce an improved symmetrical profile of output spectrum.

The pulse magnetron according to the present invention includes an anode having a number of vanes mounted radially on the inner wall of a cylindrical anode shell thereof, a cathode provided at the center of the anode to face the inner end of each vane, and a pair of pole pieces provided for applying a magnetic field substantially in parallel to the cathode across an interaction space defined between the outer side of the cathode and the inner ends of the vanes. In particular, the pulse magnetron which is pulsed for oscillation is characterized by $$V_a=942(r_a^2-r_c^2)(10^4b-10650/n\lambda)/n\lambda \quad (1)$$

where $V_a$ is the pulsed anode voltage (in V), $r_a$ is the radius of the anode (the radius in cm of an inscribed circle defined by the inner ends of the vanes), $r_c$ is the radius of the cathode surface (in cm), b is the minimum of the magnetic flux density (in Tesla) along the axis of the interaction space, n is the (number of divisions (the number of the vanes))/2, and $\lambda$ is the oscillation wavelength (in cm).

More specifically, the radius $r_a$ of the inscribed circle defined by the inner ends of the vanes and the radius $r_c$ of the cathode surface which both are determined by the foregoing equation (1) are measured at a point where the magnetic flux density is maximum along the axial direction of the cathode and the height of the vanes. Also, the anode and the cathode are arranged to satisfy at least either (i) increasing the radius of the inscribed circle defined by the inner ends of the vanes to $r_a$, or (ii) decreasing the radius of the cathode surface to $r_c$, at a point where the magnetic flux density for both cases (i) and (ii) is minimum along the axial direction of the cathode and the height of the vanes.

It is noted that the vanes represent an assembly forming cavities together with the anode shell. The vanes extend inwardly from the inner wall of the anode and may be implemented in the form of a set of sheet blades joined by brazing or the like to the inner wall of the anode shell or formed integral with the anode shell, thus called as slot type or rising sun type, by providing slots acting as the cavities.

The construction of the pulse magnetron allows the distance between the cathode and the anode at the axial ends of the cathode (the vanes) where the magnetic flux density is maximum to be determined from the minimum of the magnetic flux density along the height of the vanes in the axial direction of the cathode in the interaction space. Also, the inner diameter of the anode and/or the outer diameter of the cathode are adjusted so that the distance between the anode and the cathode increases corresponding to the magnetic flux density which is decreased towards the center of the cathode. As the result, the pulse magnetron can be increased in impedance thus minimizing the generation of unwanted oscillation at an anode voltage lower than its rated level. When the anode voltage of pulse form is applied, the oscillation starts with the rated level at each pulse in the n mode and its output spectrum can favorably be symmetrical to the main lobe. More particularly, the pulse magnetron can have characteristics close to their theoretical measurements while not exhibiting an unwanted frequency profile.

DETAILED DESCRIPTION OF THE INVENTION

Figure 1A:
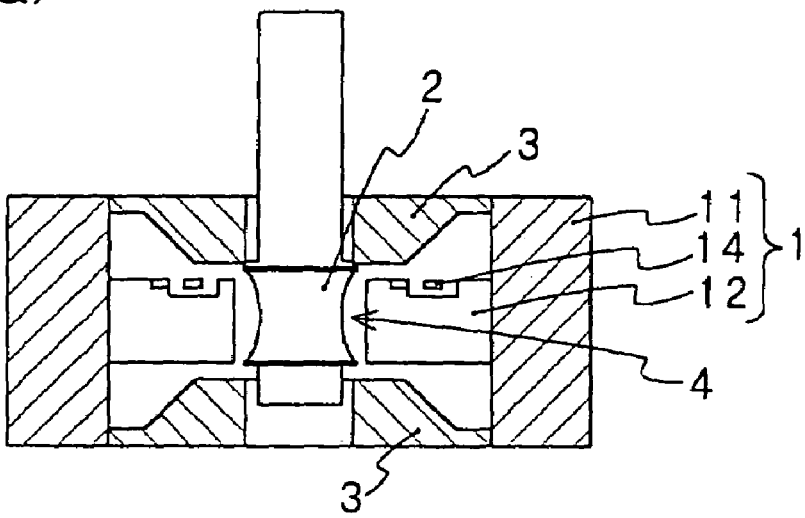
FIG. 1(*a*) is a schematic view showing the longitudinal cross section and FIG. 1(*b*) the transverse cross section of a magnetron of one embodiment of the present invention.

A pulse magnetron according to the present invention will be described in mode detail referring to the relevant drawings. A pulse magnetron according to the present invention may have a construction shown in the cross sectional view of FIG. 1(*a*) and FIG. 1(*b*), for example. More specifically, a number of vanes 12 are radially mounted on the inner wall of a cylindrical anode shell 11 thus constituting an anode 1. As a cathode 2 is provided at the center of the anode 1, a pair of pole pieces 3 are mounted to both axial ends of the anode shell 11 for applying a magnetic field substantially in parallel to the cathode 2 across the interaction space 4 between the inner ends of the vanes 12 and the outer side of the cathode 2. The height of the vanes defines the height of the interaction space in the axial direction of the cathode.

According to the present invention, the radius $r_a$ of an inscribed circle defined by the inner ends of the vanes 12 (refer to FIG. 4) and the radius $r_c$ of the cathode 2 (refer to FIG. 4) where the magnetic flux density is maximum along the axial direction of the cathode 2 and the height of the vanes 12 in the interaction space 4 are determined to satisfy the foregoing equation (1). Also, the anode 1 and the cathode 2 are modified so that the anode radius $r_a$ is increased or the cathode radius $r_c$ is decreased when the magnetic flux density is low at the center of the vanes 12 or the anode radius $r_a$ is increased and the cathode radius $r_c$ is decreased, i.e., the distance between the outer surface of the cathode and the inner ends of the vanes is increased towards the center of the height of the vanes is towards the center of the height of the vanes, i.e., towards the center of the interaction space in the axial direction of the cathode.

Figure 1B:
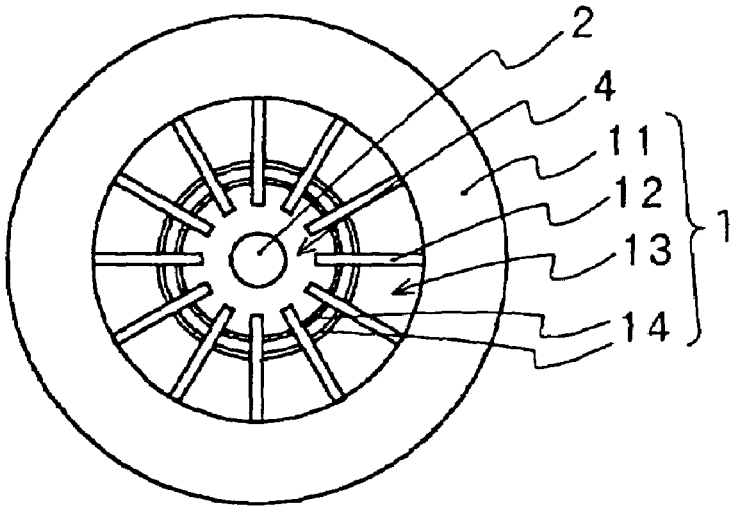

The anode 1 has, as shown in the longitudinal cross sectional view of FIG. 1(*a*) and the transverse cross sectional view of FIG. 1(*b*), its anode shell 11 made of non-oxygen copper or the like and joined at the inner wall to the outer ends of the (anode) vanes 12 which are also made of non-oxygen copper or the like. The vanes 12 extend at the other or inner end towards the center of the anode shell 11 and are spaced from each other by the cavity 13 for resonant oscillation at desired frequencies, i.e., the vanes forming a plurality of cavity resonators. The vanes 12 are alternately connected by the straps 14 to vary the $\pi$ radian phase for ease of the oscillation in the $\pi$ mode. The anode 1 may be modified with its anode shell 11 not joined to but formed integral with the vanes 12 by providing slots or cavities.

The cathode 2 is installed concentricly at the center of the anode shell 11 as surrounded by the inner ends of the vanes 12. The interaction space 4 is provided between the outer side of the cathode 2 and the inner ends of the vanes 12 for allowing electrons emitted from cathode to interact. The paired pole pieces 3 are made of a ferromagnetic material such as iron and mounted to both axial ends of the anode shell 11 hence allowing a magnetic field generated by a permanent magnet or electromagnet (these magnets are not shown) to run across the interaction space 4. As an anode voltage is impressed between the anode and the cathode, the electrons are circularly orbited about the cathode 2 by the operation of the magnetic field to transfer energy to the cavities 13 for triggering the oscillation. The magnetron used in a radar system is pulsed using the anode voltage.

Figure 4:
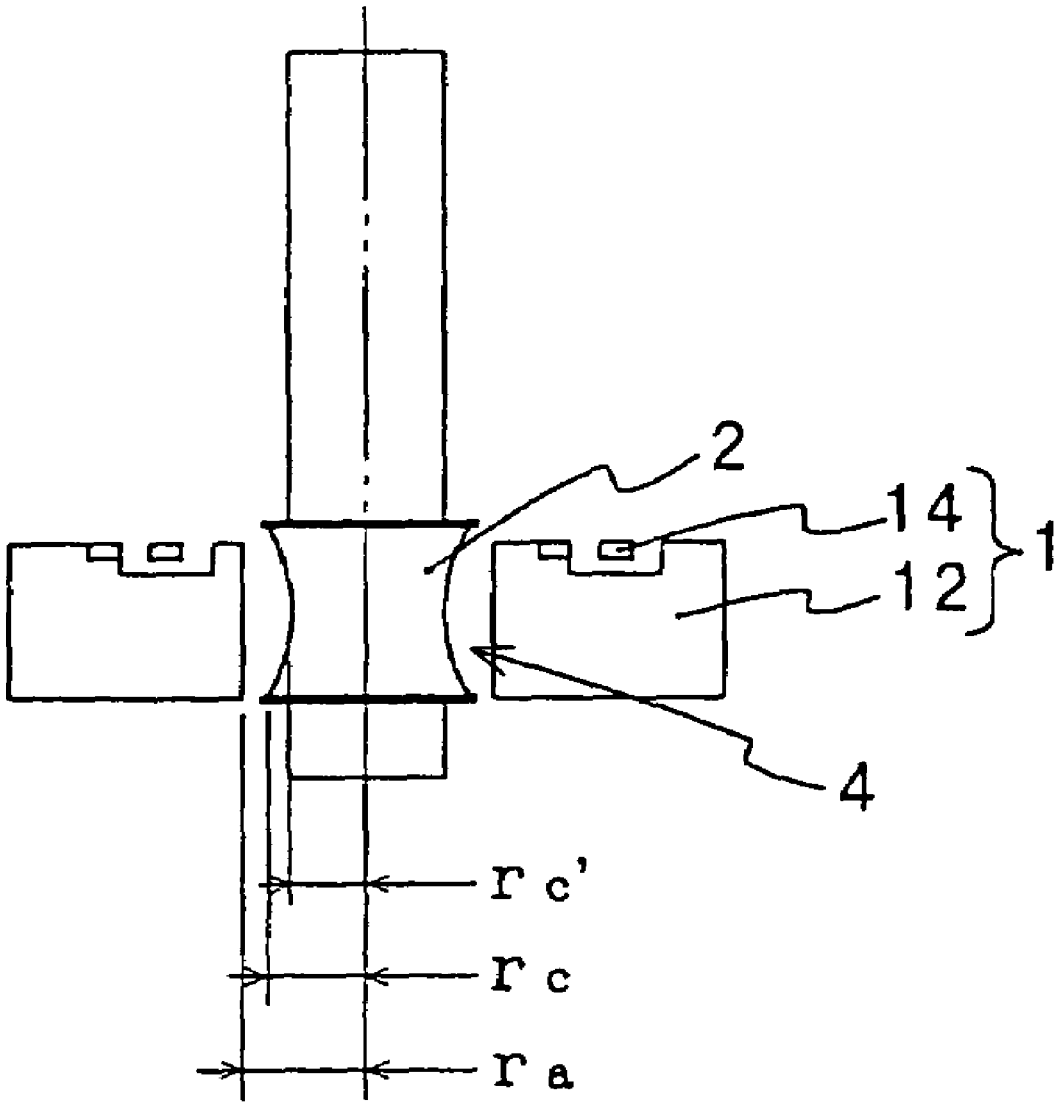
FIG. 4 is a schematic view showing the dimensional relationship between the cathode and the anode shown in FIG. 1.

The embodiment shown in FIG. 1 permits the radius of the cathode 2 to be smaller at the center than at the axial ends, then providing a concave form in the longitudinal cross section. FIG. 4 is a schematic view showing the dimensional relationship between the cathode and the anode including cathode 2, anode vanes 12 and strap 14. More particularly, as shown in FIG. 4, the radius $r_c$ at the axial ends of the cathode 2 is determined with the radius $r_a$ at the inner side of the anode 1 (the inscribed circle defined by the inner ends of the vanes 12) and the magnetic flux b in the interaction space 4 to satisfy the foregoing equation (1). As the radius $r_c'$ at the center of the cathode 2 is smaller than the radius $r_c$ at the axial ends, the cathode 2 is distanced more at the center than at the axial ends from the inner ends of the vanes 12. The magnetic flux b in the equation (1) is defined as the minimum of the magnetic flux B in the interaction space by the magnetron operation theory, "The basic of microwave technology" by Makimoto et al, Hirokawa Shoten, 1980, twelfth edition, p. 278, formula 10.28. The radius $r_a$ of the anode and the radius $r_c$ of the cathode in the equation (1) are determined so that the magnetic flux is maximum along the vanes in the axial direction of the anode. This permits an offset from the theoretical operation to increase of the distance between the cathode and the anode.

Figure 2:
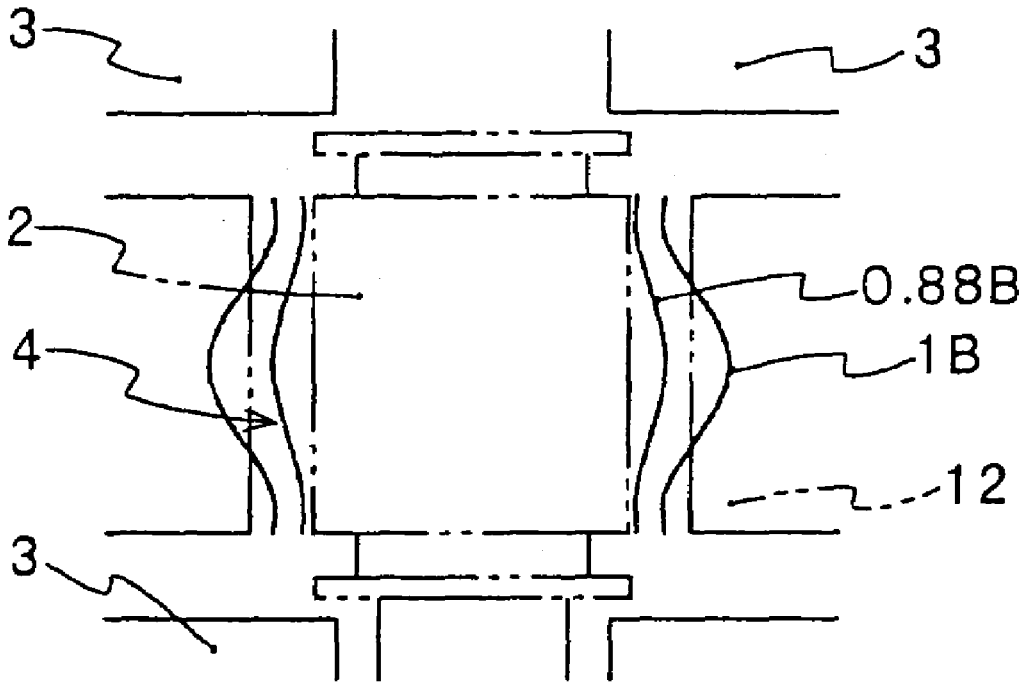
FIG. 2 is a diagram showing the equivalent magnetic flux density adjacent to the interaction space in the magnetron shown in FIG. 1(*a*) and FIG. 1(*b*)

More particularly, the radius $r_c'$ at the center in the axial direction of the cathode 2 is set with $r_c'/r_a$ smaller by 9.1% than $r_c/r_a$ ($r_c'/r_c$ being 90.9% or more). This is explained below. FIG. 2 is a diagram showing an equivalent magnetic flux density profile adjacent to the interaction space in the magnetron including cathode 2, pole piece 3, interaction space 4, wherein showing equal magnetic flux lines 1B and 0.88B, which correspond to 100% and 88% of flux density B, respectively. As shown with the equivalent magnetic flux density profile in FIG. 2, the magnetic flux at the center of the cathode 2 in the interaction space 4 in the magnetron of FIG. 1 is equal to 88% of that at the axial ends. When the radius at the center of the cathode 2 is equal to that at the axial ends, the magnetic flux becomes smaller at the center thus allowing the operation to start at a lower level of the anode voltage. More particularly, the oscillation starts at the center in the axial direction when the pulsed anode voltage is increased. Accordingly, the generation of spurious radiation will occur at lower frequencies than the fundament oscillation frequency at the rise of each pulse signal.

That is, as described above, when the magnetron is pulsed, its anode voltage rises from 0 V to a rated level, remains for a predetermined length of the pulse, and decays. This operation is repeated at every pulse. The oscillation of the magnetron can start when the current is as small as 5 to 10% of the rated level. Accordingly, the output is then 40 to 50 dB lower than the rated level. Such undesired oscillation at lower frequencies than the fundamental oscillation frequency then continues until the current reaches to its rated level. As the result, the spectrum of the output will be unsymmetrical showing a noticeable profile of −40 to −50 dBc (decibels) at one sideband or any other unwanted profile deviated from the profile of desired frequencies.

The pulse magnetron according to the present invention shown in FIG. 1 however has the cathode 2 arranged smaller in the radius at the center in the axial direction than at the axial ends; $r_c'/r_a$ at the center being smaller by 9.1% than $r_c/r_a$ at the axial ends. This permits the oscillation not to start before the anode voltage reaches a specific level. When the anode voltage reaches its specific level, the oscillation starts simultaneously at both the center and the axial ends along the axial direction of the vanes 2. As a result, the pulse magnetron is inhibited from oscillating at lower frequencies than the fundamental oscillation frequency and its output spectrum can be improved in the profile.

Figure 5:
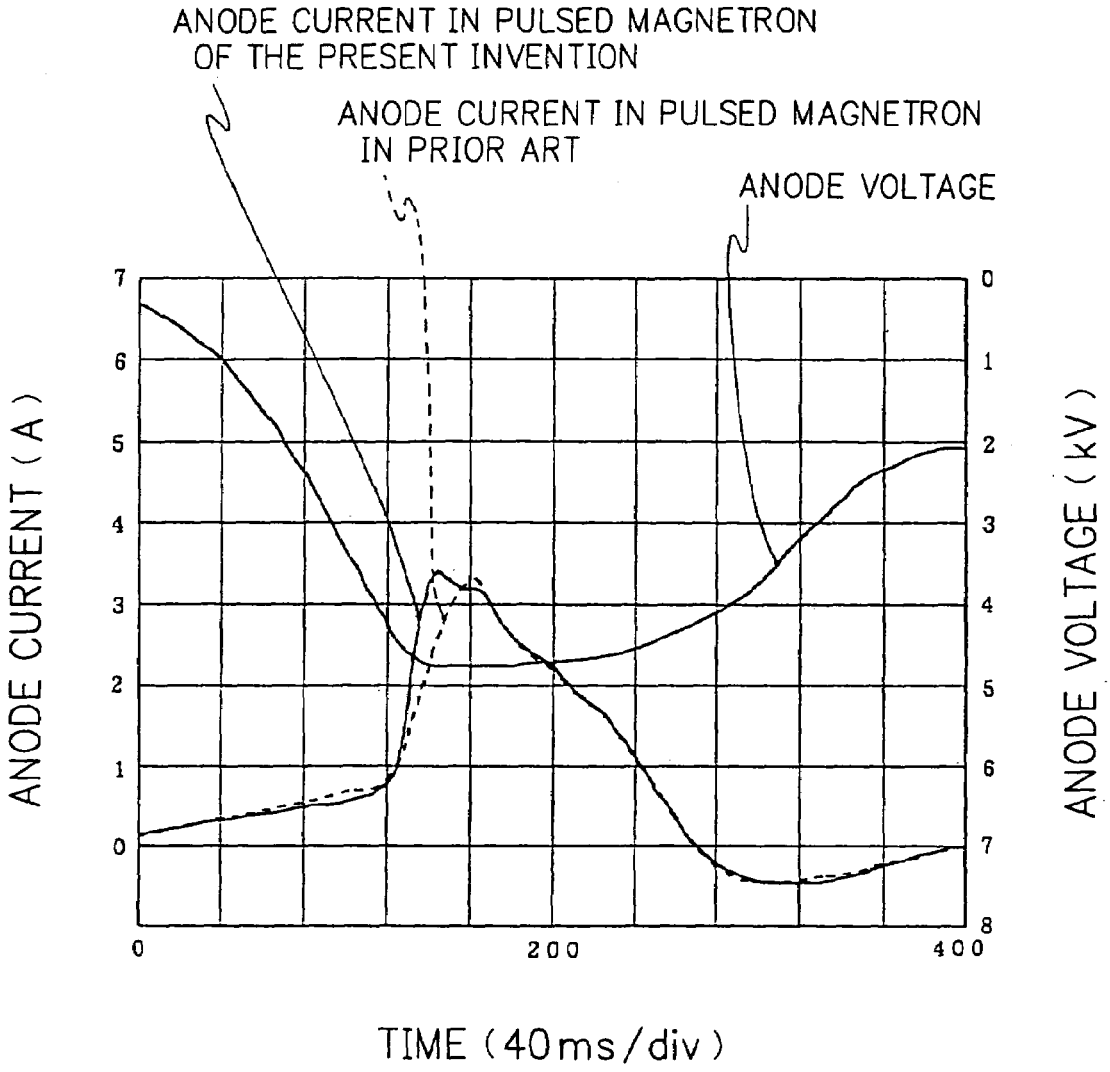
FIG. 5 is a diagram showing comparison in the anode current waveform between the pulse magnetron of the embodiment of the present invention and a conventional pulse magnetron.

FIG. 5 illustrates in comparison the anode current waveform between the pulse magnetron of the present invention and a conventional pulse magnetron. The anode current and the anode voltage are plotted along the time base (the horizontal axis) in FIG. 5. In the conventional pulse magnetron, before the anode voltage pulsed up reaches its rated level, the anode current starts running because the magnetic flux density at the center in the axial direction of the cathode, as predetermined theoretically, remains low. This triggers oscillation at frequencies lower than the fundamental oscillation frequency. The pulse magnetron of the present invention has an increasing distance arranged between the anode and the cathode toward the center of the interaction space thus providing a higher level of transit impedance at the beginning of the rise of the anode voltage and allowing no current to flow. When the anode voltage reaches its rated level, the anode current starts running at once throughout the whole vanes. For example, the anode current in the pulse magnetron of the present invention rises up at 0.15 to 0.2 A/ns while that of the conventional magnetron is as low as 0.08 to 0.1 A/ns. As the pulse magnetron of the present invention is dynamically varied in the transient impedance, its anode current rises up sharply within an instant thus eliminating unwanted oscillation.

Figure 3:
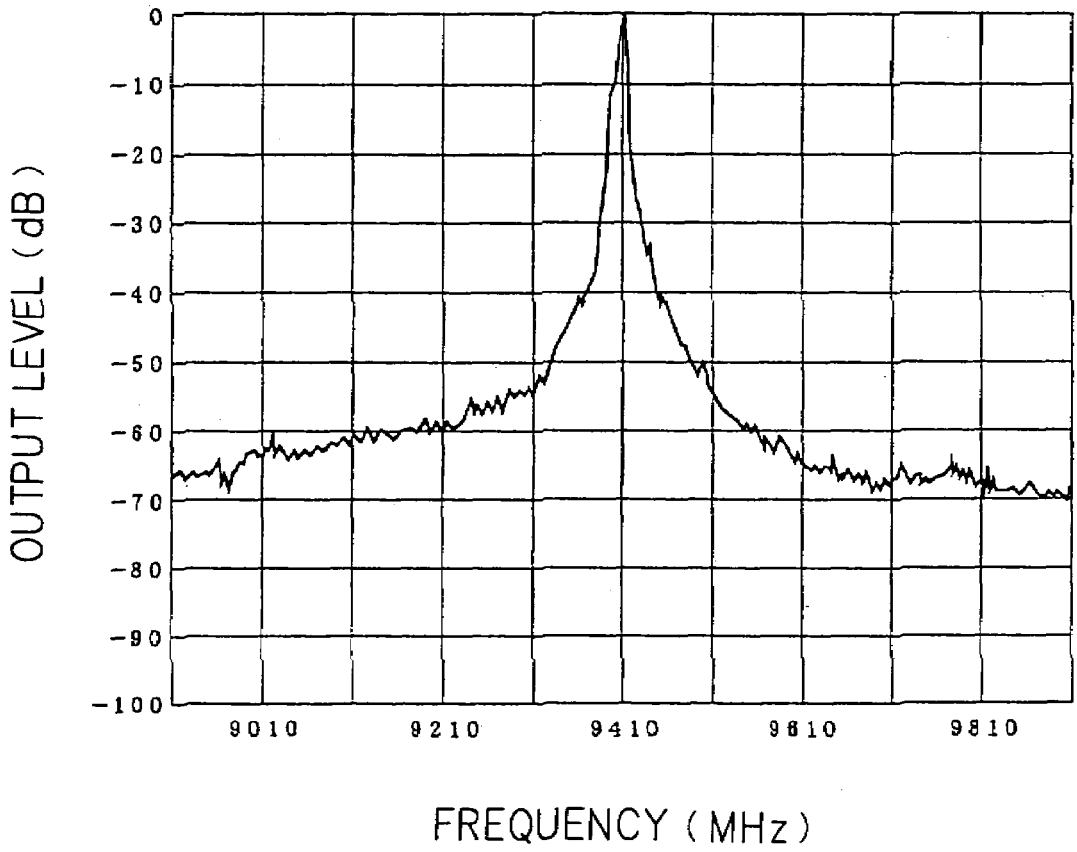
FIG. 3 is a spectrum diagram of the oscillation output of the magnetron having a construction shown in FIG. 1(*a*) and FIG. 1(*b*)

FIG. 3 illustrats the oscillation output spectrum of the pulse magnetron according to the present invention, wherein vertical axis shows output level in dB and horizontal axis shows frequency in MHz. As apparent from FIG. 3, the oscillation occurs at the $\pi$ mode fundamental frequency while no undesired profile is shown in both sidebands. The fundamental oscillation frequency is 9410 MHz in FIG. 3.

The fact that $r_c'/r_a$ at the center is smaller by 9.1% than $r_c/r_a$ at the axial ends is determined by the foregoing equation (1) when the magnetic flux density, as shown in FIG. 2, at the center is 88% (i.e., 0.88 B) of the maqnetic flux density at the axial ends of the cathode 2. The magnetic flux density may be varied depending on the structure of the magnetron and the shape of and the distance between the pole pieces. However, with the magnetic flux density remaining described as above, the spectrum profile can equally be improved when the cathode 2 is arranged to a concave shape so that $r_c'/r_a$ is smaller by simply 0.3% than $r_c/r_a$. Accordingly, the distance between the anode and the cathode is not necessarily modified to match the profile of the magnetic flux density. Also, the pulse magnetron used in a radar system has generally a profile of the magnetic flux density where the smallest is 88% or more of the maximum. Accordingly, when $r_c'/r_a$ is smaller by 9.1% to 0.3% than $r_c/r_a$, the output spectrum can be improved hence minimizing the generation of spurious radiation. Also, the concave shape of the cathode may be implemented using a quadratic function curve, a combination of linear lines in a sequence. Moreover, the radii may be varied in steps instead of continuosly.

As described, the radius of the cathode 2 is smaller at the center in the axial direction than at the axial ends thus to inhibit the oscillation at a current smaller than the rated level. As long as the cathode is modified in the radius, the anode may be formed integrally by providing slots. This allows the distance between the anode and the cathode to be easily adjusted to a desired length without changing the inner radius of the anode. Since the distance between the anode and the cathode is dependent on the profile of the magnetic flux density, the inner diameter of the anode at the center in the axial direction where the magnetic flux density is low may be increased for providing the equal effect. This arrangement is shown in FIG. 6 where the positional relationship between the anode 1 (including vanes 12 and strap 14) and the cathode 2 in the neighborhood of interaction space 4 is equal to that shown in FIG. 4.

Figure 6:
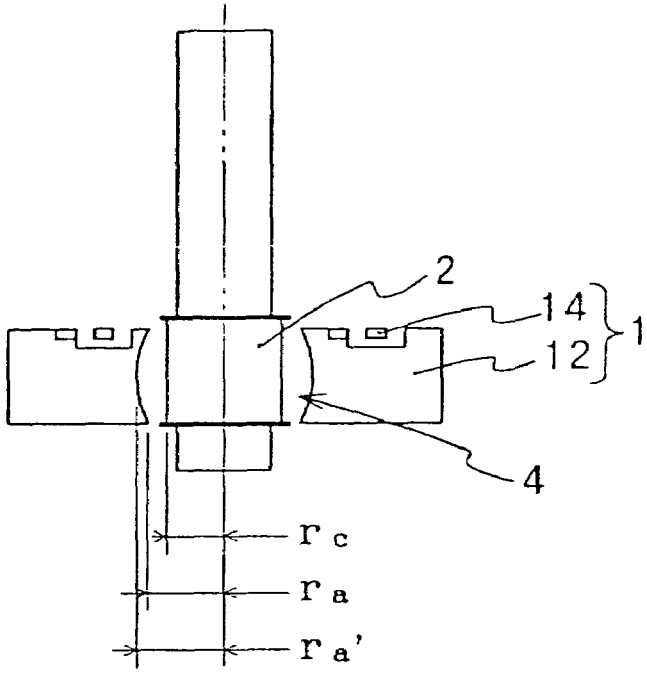
FIG. 6 is a schematic view adjacent to the interaction space showing a magnetron of another embodiment of the present invention.
Figure 7:
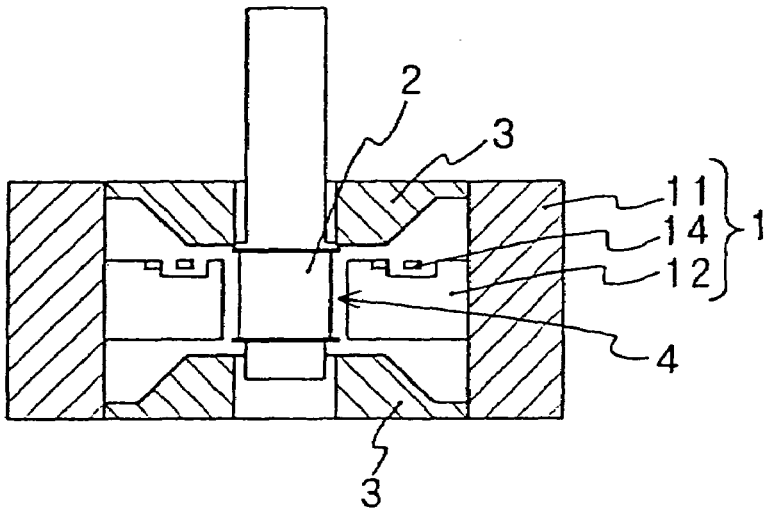
FIG. 7 (PRIOR ART)
FIG. 7 is a schematic cross sectional view of one example of a configuration of a conventional magnetron.
Figure 8:
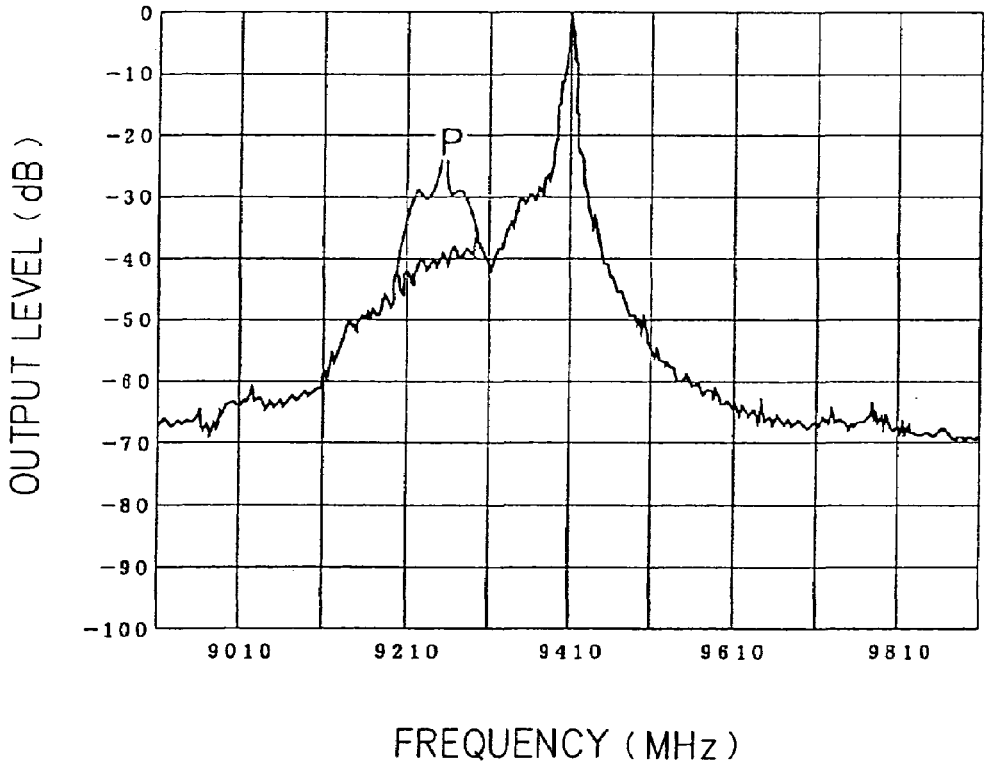
FIG. 8 (PRIOR ART)
FIG. 8 is a spectrum diagram of the oscillation output of the conventional magnetron.

More specifically, the arrangement shown in FIG. 6 is provided where the radius $r_a$ of an inscribed circle defined by the inner ends at both axial ends of the vanes 12 and the radius $r_c$ of the cathode 2 are determined to satisfy the foregoing equation (1). As the inner ends of the vanes 12 are arranged of a concave shape, the radius $r_a'$ of an inscribed circle defined by the inner ends at the center in the axial direction of the vanes 12 is determined so that $r_c/r_a'$ is smaller by 9.1% than $r_c/r_a$. In other words, the radius $r_a'$ of an inscribed circle defined by the inner ends at the center of the vanes 12 is greater by 9.1% than the radius $r_a$ of an inscribed circle at the axial ends.

While the cathode 2 remains equal in the radius along the axial direction, the inscribed circle of the anode 1 is increased in the radius at the center in the axial direction. This allows the positional relationship between the anode and the cathode to be identical to that of the previous arrangement where the shape of the cathode is modified, thus providing the same effect. Accordingly, the oscillation starts simultaneously at the center and the axial ends of the vanes 12 when the same anode voltage $V_0$ is applied. Equally, the shape of the inner end of each vane 12 may be implemented using a quadratic function curve, a combination of linear lines in a sequence. Also, when the magnetic flux density is varied to 88%, the output spectrum can be improved with $r_c/r_a'$ arranged smaller by 9.1% to 0.3% than $r_c/r_a$, hence minimizing the generation of spurious radiation.

Furthermore, while either the anode or the cathode is modified in the previous arrangement, both the anode and the cathode may be arranged of desired shapes without increasing the degree of modification.

As set forth above, the present invention can successfully minimize any unwanted oscillation at the rise and decay periods of each pulse. More specifically, the pulse magnetron according to the present invention allows the oscillation in the π mode to start stably at the beginning of the rise of each pulse of the anode voltage and stop instantly upon the decay of the pulse. This suppresses the generation of spurious radiation. Accordingly, when used in a radar system, the pulse magnetron of the present invention avoids the need to use a filter which could reduce the space saving and increase the overall weight, thus contributing to the reduction of the cost, the size, and the weight of the radar system.

Though several embodiments of the present invention are described above, it is to be understood that the present invention is not limited only to the above-mentioned, various changes and modifications may be made in the invention without departing from the spirit and scope thereof.

What is claimed is:

1. A pulse magnetron which is pulsed for oscillation, comprising:

an anode having a number of vanes mounted radially on an inner wall of a cylindrical anode shell thereof;

a cathode provided at a center of the anode to face an inner end of each vane; and a pair of pole pieces provided for applying a magnetic field substantially in parallel to the cathode across an interaction space defined between an outer side of the cathode and the inner ends of the vanes;

wherein a radius $r_a$ of an inscribed circle defined by the inner ends of the vanes and a radius $r_c$ of the cathode surface are determined by an equation $$V_a=942(r_a^2-r_c^2)\,(10^4 b-10650/n\lambda)/n\lambda,$$

wherein $V_a$ is a pulsed anode voltage in volts, said radius $r_a$ and said radius $r_c$ are in cm, b is a minimum magnetic flux density in Tesla along an axial direction of the interaction space, said axial direction being parallel to said inner wall, n is given by: (a number of divisions (the number of the vanes))/2, and λ is an oscillation wavelength in cm;

wherein said equation is modified such that said radius $r_a$ and said radius $r_c$ identify a point where magnetic flux density is maximum along said axial direction of the interaction space;

wherein the anode and the cathode are arranged to satisfy either (i) increasing the radius of the inscribed circle defined by the inner ends of the vanes to a radius $r_a'$ or (ii) decreasing the radius of the cathode surface to a radius $r_c'$ at a point where the magnetic flux density for both cases (i) and (ii) is minimum along said axial direction of the interaction space for points corresponding to radiuses $r_a'$ or $r_c'$.

2. A pulse magnetron of claim 1, wherein a distance between the outer surface of the cathode and the inner ends of the vanes towards a center along the axial direction of said interaction space is increased.

* * * * *

UNITED STATES PATENT AND TRADEMARK OFFICE

CERTIFICATE OF CORRECTION

PATENT NO. : 7,038,387 B2
APPLICATION NO. : 10/712831
DATED : May 2, 2006
INVENTOR(S) : Hideyuki Obata and Nakoi Tsuji It is certified that error appears in the above-identified patent and that said Letters Patent is hereby corrected as shown below:

In column 4, lines 19 and 20 "towards the center of the height of the vanes is" should be deleted.

Signed and Sealed this

Fourteenth Day of November, 2006

JON W. DUDAS
*Director of the United States Patent and Trademark Office*